US006225243B1

(12) United States Patent
Austin

(10) Patent No.: US 6,225,243 B1
(45) Date of Patent: May 1, 2001

(54) ELASTIC NONWOVEN FABRIC PREPARED FROM BI-COMPONENT FILAMENTS

(75) Inventor: Jared A. Austin, Greer, SC (US)

(73) Assignee: BBA Nonwovens Simpsonville, Inc., Simpsonville, SC (US)

( * ) Notice: Subject to any disclaimer, the term of this patent is extended or adjusted under 35 U.S.C. 154(b) by 0 days.

(21) Appl. No.: 09/128,399

(22) Filed: Aug. 3, 1998

(51) Int. Cl.[7] ..... D04H 1/06

(52) U.S. Cl. ..... 442/361; 442/362; 442/364; 442/328; 442/329

(58) Field of Search ..... 442/361, 362, 442/364, 328, 329

(56) References Cited

U.S. PATENT DOCUMENTS

| | | | | |
|---|---|---|---|---|
| 3,353,345 | | 11/1967 | Setzer . | |
| 4,107,364 | | 8/1978 | Sisson . | |
| 4,405,686 | | 9/1983 | Kuroda et al. . | |
| 4,663,220 | | 5/1987 | Wisneski et al. . | |
| 4,663,221 | * | 5/1987 | Makimura et al. | 428/224 |
| 4,720,415 | | 1/1988 | Vander Wielen et al. . | |
| 5,068,142 | * | 11/1991 | Nose et al. | 428/232 |
| 5,108,820 | * | 4/1992 | Kaneko et al. | 428/198 |
| 5,162,074 | | 11/1992 | Hills . | |
| 5,164,262 | | 11/1992 | Kobayashi et al. . | |
| 5,171,633 | | 12/1992 | Muramoto et al. . | |
| 5,308,697 | | 5/1994 | Muramoto et al. . | |
| 5,336,552 | * | 8/1994 | Strack et al. | 428/224 |
| 5,352,518 | | 10/1994 | Muramoto et al. . | |
| 5,382,400 | * | 1/1995 | Pike et al. | 264/168 |
| 5,405,682 | | 4/1995 | Shawyer et al. . | |
| 5,429,856 | | 7/1995 | Krueger et al. . | |
| 5,456,982 | * | 10/1995 | Hansen et al. | 428/370 |
| 5,462,793 | | 10/1995 | Isoda et al. . | |
| 5,466,505 | | 11/1995 | Fukuda et al. . | |
| 5,470,639 | | 11/1995 | Gessner et al. . | |
| 5,545,464 | | 8/1996 | Stokes . | |
| 5,899,785 | * | 5/1999 | Groten et al. | 442/334 |
| 5,916,678 | * | 6/1999 | Jackson et al. | 428/373 |
| 6,001,752 | * | 12/1999 | Ishisawa et al. | 442/632 |

FOREIGN PATENT DOCUMENTS

| | | | | |
|---|---|---|---|---|
| 0496888 A1 | | 9/1992 | (EP) . | |
| 1112045 | * | 5/1968 | (GB) | D03D/15/08 |
| WO 93/07323 | | 4/1993 | (WO) . | |
| WO 93/15251 | | 8/1993 | (WO) . | |
| WO 94/25648 | | 11/1994 | (WO) . | |

OTHER PUBLICATIONS

Patent Abstracts of Japan, vol. 1998, No. 03, Feb. 27, 1988 and JP 09 291454 A (KAO Corp.), Nov. 11, 1997, abstract.

Patent Abstracts of Japan, vol. 012, No. 037 (C–473), Feb. 4, 1988 and JP 62 184118 A (Chisso Corp.), Aug. 12, 1987, abstract.

Database Chemabs 'Online!, Chemical Abstracts Service, Columbus, Ohio, US, Abe, Morio et al: "Biocomponent spandex fibers" retrieved from STN, Database accession No. 105:228441, XP–002125307 abstract and JP 61 194221 A (Chisso Corp., Japan), Aug. 28, 1986.

* cited by examiner

*Primary Examiner*—Terrel Morris
*Assistant Examiner*—Norca L. Torres
(74) *Attorney, Agent, or Firm*—Alston & Bird LLP

(57) ABSTRACT

A bonded web of multi-component strands that include a first polymeric component and a second polymeric component is capable of overcoming a number of problems associated with nonwoven webs including both stickiness and blocking. The first polymeric component and second polymeric components are arranged in substantially distinct zones extending longitudinally along at least a portion of a length of the strands which make up the web with the second component containing a zone constituting at least a portion of the peripheral surface of the strand. Moreover, the first polymeric component has an elasticity which is greater than that of the second polymer component.

A process producing elastomeric spunbonded nonwoven fabrics which utilizes air in attenuating and/or drawing of strands is also provided.

18 Claims, 7 Drawing Sheets

ELASTIC NONWOVEN FABRIC PREPARED FROM BI-COMPONENT FILAMENTS

STATEMENT REGARDING FEDERALLY SPONSORED RESEARCH OR DEVELOPMENT

This invention was made with United States Government support under Advanced Technology Program Grant 1995-05-0039B awarded by the National Institute of Standards and Technology. The United States Government has certain rights in the invention.

FIELD OF THE INVENTION

The invention relates to nonwoven fabrics produced from multi-component strands, processes for producing nonwoven webs and products using the nonwoven webs. The nonwoven webs of the invention are preferably produced from multi-component strands including at least two components, a first, elastic polymeric component and a second, extensible but less elastic polymeric component.

BACKGROUND OF THE INVENTION

Elastic nonwoven fabrics can be employed in a variety of environments such as bandaging materials, garments, diapers, support clothing, and personal hygiene products because of their breathability as well as their ability to allow more freedom of body movement than fabrics with more limited elasticity.

Nonwoven fabrics are commonly made by melt spinning thermoplastic materials. Such fabrics are called "spunbond" materials and methods for making spunbond polymeric materials are also well known in the field. While spunbond materials with desirable combinations of physical properties, especially combinations of softness, strength and durability, have been produced, significant problems have been encountered.

One problem is attributed to the characteristic "sticky" nature of the elastomers typically employed in producing nonwoven materials. Processes such as spunbonding which employ air drawing can be particularly effected. For example, turbulence in the air can bring filaments into contact and these "sticky" filaments can then adhere to one another. This stickiness proves to be especially troublesome during winding of the webs into rolls. The layers of web adhere to one another, a phenomenon known as "blocking".

Certain methods have been developed in an attempt to overcome this problems. One such method is described in U.S. Pat. No. 4,720,415, where an elastic web is stretched and nonelastic fabrics are calendar bonded to the web, which is then allowed to contract. Such a "stretch-bonded" laminate has extensibility determined by the original extent of the stretching during the lamination process. Any attempt to stretch the laminate beyond this limit is resisted by the nonelastic layers on both sides of the elastic web.

Another method for overcoming the "stickiness" of elastic webs is to laminate one or two layers of an extensible nonwoven fabric to the web in the unstretched state. The extensible fabrics can typically be extended up to 200% or more in one or two directions, but they possess little recovery force after the extension. Therefore, the elastic web component provides the recovery force in the resulting laminate. Examples of such arrangements are described in U.S. Pat. Nos. 4,981,747, and 5,543,206 as well as PCT WO 96/16216.

Yet another method which attempts to overcome the inherent "stickiness" of webs made from elastic filaments involves mixing nonelastic fibers among the elastic filaments, so that the resulting composite fabric does not have a high level of stickiness. Such fabrics can be more easily unwound from rolls. A convenient way of mixing elastic filaments and inelastic fibers is by the "hydroentanglement" process. This approach is described in U.S. Pat. Nos. 4,775,579 and 4,939,016. Another approach to mixing involves blending an air stream containing inelastic staple fibers with an air stream containing elastic filaments. This approach is described in U.S. Pat. No. 4,803,117.

While these methods are capable of decreasing the effect of the stickiness of the elastic filaments, they introduce a significant complication into the process for producing an elastic nonwoven fabric. Such complications can result in a significant addition to the cost of the resulting fabric.

In addition to the "stickiness" issue, attempts to provide spunbond elastomeric polymers have faced problems such as breakage or elastic failure of the strand during extrusion and/or drawing. Broken strands can clog the flow of filaments and/or mesh with other filaments, resulting in the formation of a mat of tangled filaments in the web.

While the art has sought to address the foregoing problems, it is clear that the results have, at best, been mixed.

Separately, attempts have been made to influence the properties of fabrics by modifying the content of the fibers. For example, it has been known "combine" polymers in bi-and multicomponent fibers.

Bi-component fibers were the subject of U.S. Pat. Nos. 5,352,518 and 5,484,645. The '518 patent illustrates a composite elastic filament in a sheath-core arrangement in which the sheath component is composed of a thermoplastic polymer, such as a polyamide, polyester or polyolefin while the core is composed of an elastomer, such as a polyurethane or polyester elastomer.

The use of multi-component strands is also found in U.S. Pat. No. 5,405,682 to Shawyer et al. This patent discloses filaments that are employed in the production of nonwoven fabrics and which include, as one component, a blend of polyolefin and elastomer material. Once again, the polymeric strands are preferably in a sheath and core arrangement in which the sheath comprises a blend of a polyolefin and a thermoplastic elastomeric polymer.

It is also known to employ mixtures of fibers in forming nonwoven fabrics. See, for example, U.S. Pat. Nos. 3,353,345 and 4,107,364.

U.S. Pat. No. 3,353,345 illustrates an inelastic blend of stable fibers that includes both hard staple fibers that are essentially inelastic and bi-component staple fibers that comprise both a hard inelastic fiber component and one or more elastomeric fiber components. The two components are arranged such that the hard component will separate from the elastic component when exposed to heat or hot wet conditions without tension.

U.S. Pat. No. 4,107,363 relates to a nonwoven fabric produced by at least two types of fibers or filaments, one of which is elastomeric and another being elongated but nonelastic. In particular, this patent discloses an arrangement which includes a random web on a continuous filament cloth.

SUMMARY OF THE INVENTION

The present invention is based, at least in part, on the surprising discovery that bonded webs made from a plurality of strands comprising at least two polymeric components where one component is elastic and another component is less elastic but extensible, can overcome a variety of problems in the field.

In a first aspect, the present invention relates to a bonded web of multi-component strands that include a first polymeric component, and a second polymeric component, where the second component is less elastic than the first component. The two components are arranged in substantially distinct zones extending longitudinally along at least at a portion of the length of the strands with the second component containing zones constitutes at least a portion of the periphery of the strands.

It is more preferred that the first component containing zone is contained to the interior of the strands, with a "shell-and-core" arrangement being even more preferred. In this shell-and-core arrangement, the first component constitutes the core and the second component constitutes the shell.

Another aspect of the present invention relates to products produced for the bonded webs. Yet another aspect of the invention involves processes for producing the webs, and, in particular, processes for producing an elastomeric spunbonded nonwoven web which employs air in attenuating and/or drawing of the strands.

DETAILED DESCRIPTION OF THE PREFERRED EMBODIMENT

As discussed above, one aspect of the present invention relates to the production and use of webs produced from strands having at least two polymeric components, a first polymeric component and a second polymeric component.

In this invention, "strand" is being used as a term generic to both "fiber" and filament". In this regard, "filaments" are referring to continuous strands of material while "fibers" mean cut or discontinuous strands having a definite length. Thus, while the following discussion may use "strand" or "fiber" or "filament", the discussion can be equally applied to all three terms.

The first component is an "elastic" polymer(s) which refers to a polymer that, when subjected to an elongation, deforms or stretches within its elastic limit. The second component is also a polymer(s), preferably a polymer which is extensible. The second component polymer may have elastic recovery and may stretch within its elastic limit as the bi-component strand is stretched. However, this second component is selected to provide poorer elastic recovery than the first component polymer.

Figure 3:
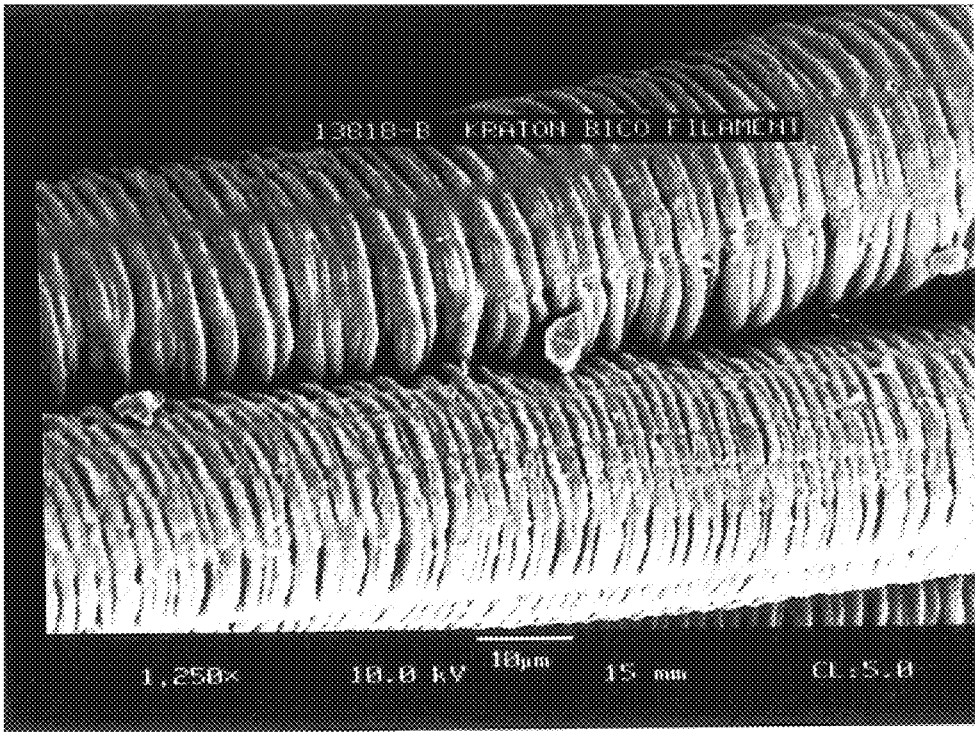
FIGS. 3, 4A, 4B, 5A and 5B are scanning electron micrographs of bi-component filaments according to the present invention.

The second component may also be a polymer which can be stretched beyond its elastic limit and permanently elongated by the application of tensile stress. For example, when an elongated bi-component filament having the second component at the surface thereof contracts, the second component will typically assume a compacted form, providing the surface of the filament with a rough appearance. (See FIG. 3).

The first and second components are present in longitudinally extending "zones" of the strand.

Figure 1A:
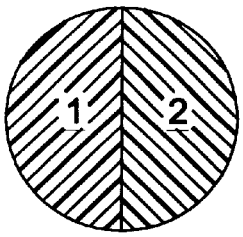
FIGS. 1A–1F illustrate a cross sectional view of strands made in accordance with the present invention.
Figure 1B:
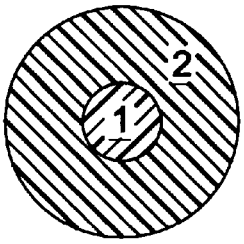
Figure 1C:
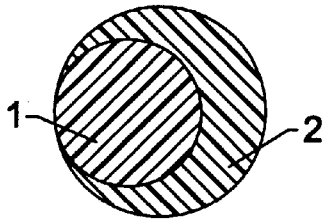
Figure 1D:
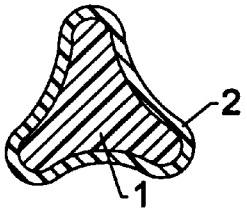

The arrangement of the longitudinally extending zones in the strand can be seen from the cross-sectional views set forth in FIGS. 1A–1F. As can be seen in each of these figures, the first polymeric component, 1, and second polymeric component, 2, are present in substantially distinct zones in the strand. It is preferred that zones of the second component constitute the peripheral surface of the strand, as illustrated by FIGS. 1B and 1C, with a symmetric shell and core arrangement such as that of FIG. 1B being more preferred.

Figure 1E:
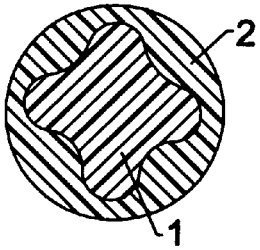
Figure 1F:
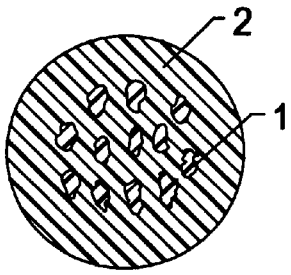

Other possible cross sections are trilobal (FIG. 1D) and round with a quadrilobal core (FIG. 1E). Still another possibility is the "islands in a sea" cross section (FIG. 1F). In the "islands in a sea" configuration, the first component is distributed into a number of fine continuous strands.

In order to have the best elastic properties, it is advantageous to have the elastic first component occupy the largest part of the filament cross section.

This aspect of the invention can be qualified in terms of recoverable elongation in the machine and cross direction of, e.g., a web produced from the strands. Preferably, when the strands are employed in a bonded web environment, the bonded web has a root mean square average recoverable elongation of at least about 65% both on machine direction and cross direction recoverable elongation values after 50% elongation and one pull.

To this end, the second component is typically present in an amount less than about 50 percent by weight of the strand, with between about 1 and about 20 percent being preferred and about 5–10 percent being even more preferred, depending on the exact polymer(s) employed as the second component.

Moreover, where the second component is substantially not elastic, it is preferred that the second component be present in an amount such that the strand becomes elastic only upon stretching of the strand by an amount sufficient to irreversibly alter the length of the second component.

Suitable materials for use as the first and second components are limited solely by the desired function for the strand. Preferably, the polymers used in the components of the invention have melt flows from about 5 to about 1000. Generally, the meltblowing process will employ polymers of a higher melt flow than the spunbonded process.

The elastomeric block copolymers are examples of suitable materials for the first component. For example, diblock and triblock copolymers based on polystyrene (S) and unsaturated or fully hydrogenated rubber blocks. The rubber blocks can consist of butadiene (B), isoprene (I), or the hydrogenated version, ethylene-butylene (EB). Thus, S-B, S-I, S-EB, as well as S-B-S, S-I-S, and S-EB-S block copolymers can be used.

Preferred elastomers of this type include the KRATON polymers sold by Shell Chemical Company and the VECTOR polymers sold by DEXCO. Other elastomeric thermoplastic polymers include polyurethane elastomeric materials such as ELASTOLLAN sold by BASF, ESTANE sold by B.F. Goodrich Company, polyester elastomers such as HYTREL sold by E.I. Du Pont De Nemours Company, polyethester elastomeric materials such as ARNITEL sold by Akzo Plastics; and polyetheramide materials such as PEBAX sold by Elf Atochem Company. Heterophasic block copolymers, such as those sold by Montel under the trade name CATALLOY are also advantageously employed in the invention. Also suitable for the invention are polypropylene polymers and copolymers described in U.S. Pat. No. 5,594,080.

Polymer blends of elastomers, such as those listed above, with one another and with thermoplastic polymers, such as polyethylene, polypropylene, polyester, nylon, and the like, may also be used in the invention. Those skilled in the art will recognize that elastomer properties can be adjusted by polymer chemistry and/or blending elastomers with non-elastomeric polymers to provide elastic properties ranging from full elastic stretch and recovery properties to relatively low stretch and recovery properties.

Where the first component is to be a blend of one of more elastomers, the materials are first combined in appropriate amounts and blended. Among the commercially well suited mixers that can be used include the Barmag 3DD three-dimensional dynamic mixer supplied by Barmag AG of Germany and the RAPRA CTM cavity-transfer mixer supplied by the Rubber and Plastic Research Association of Great Britain.

Elastomeric polyolefins can advantageously be used as the first component. For example, elastomeric linear low density polyethylene, such as Insite 58200.02, available from Dow Chemical, and Exact 5009, available from the Exxon Chemical Company, can be used. as the first component.

Advantageously, the second component can be prepared from extensible polymer blends such as those described in U.S. Pat. No. 5,543,206 and WO 96/16216. These polyolefin blends form fibers which have high elongations, but which have only a limited amount of recovery. Filaments made from these polymers have a soft hand with a very little "stickiness" or surface friction.

One specific example of a suitable second component is a polyethylene/polypropylene blend. Typically, polyethylene and polypropylene are blended in proportions such that the material comprises between 2 and 98 percent by weight polypropylene, balance polyethylene.

In one embodiment the fiber composition preferably ranges from 5 to 50 percent by weight polypropylene and 50 to 95 percent by weight polyethylene. Especially suited for applications requiring good elasticity, tensile strength and abrasion resistance are fiber compositions of from 5 to 25 percent by weight, more preferably 10 to 20 percent by weight, polypropylene of a melt index of 20 g/10 min. (ASTM D1238-89, 230° C.) or greater and 75 to 95 percent, more preferably 80–90 percent, by weight linear low density polyethylene.

However, in applications where tensile strength is particularly important and high elasticity is of lesser concern, a polypropylene-rich blend can be used. An example, the extensible, non-elastic material can comprise a polyethylene/polypropylene blend where the polyethylene is present in the range of 2.5% to 10% and the polypropylene is present in the range of 90% to 97.5% by weight.

Various types of polyethylene may be employed in the blend with the most preferred being linear, low density polyethylenes discussed in connection with the first component. LLDPE can be produced such that various density and melt index properties are obtained which make the polymer well suited for melt-spinning with polypropylene. Linear low density polyethylene (LLDPE) also performs well in filament extrusion. Preferred density values range from 0.87 to 0.95 g/cc with 0.90 to 0.94 being more preferred, and preferred melt index values usually range from 0.2 to about 150 g/10 min. (ASTM D1238-89, 190° C.).

In general, the propylene component can be an isotactic or syndiotactic polypropylene homopolymer, copolymer, or terpolymer with the most preferred being in the form of a homopolymer. For the purposes of the invention, polypropylene is preferably produced at melt index values suitable for melt spinning with polyethylene. Examples of commercially available polypropylene polymers which can be used in the present invention include SOLTEX Type 3907 (35 MFR, CR grade), HIMONT Grade X10054-12-1 (65 MFR), Exxon Type 3445 (35 MFR), Exxon Type 3635 (35 MFR) and AMOCO Type 10-7956F (35 MFR), Aristech CP 350 JPP.

As was the case with the first component, where the second component is a blend, the polymer materials, e.g., polyethylene and polypropylene, are combining in appropriate proportional amounts and intimately blended before producing the fibers.

While the principal components of the multi-component strands of the present invention have been described above, such polymeric components can also include other materials which do not adversely affect the multi-component strands. For example, the first and second polymeric components can also include, without limitation, pigments, antioxidants, stabilizers, surfactants, waxes, flow promoters, solid solvents, particulates and material added to enhance processability of the composition.

The strands according to the present invention can be used in the formation of fabrics, and, in particular, nonwoven fabrics.

Nonwoven webs can be produced by techniques that are recognized in the art. A class of processes, known as spunbonding is the most common method for forming spunbonded webs. Examples of the various types of spunbonded processes are described in U.S. Pat. No. 3,338,992 to Kinney, U.S. Pat. No. 3,692,613 to Dorschner, U.S. Pat. No. 3,802,817 to Matsuki, U.S. Pat. No. 4,405,297 to Appel, U.S. Pat. No. 4,812,112 to Balk, and U.S. Pat. No. 5,665,300 to Brignola et al. In general, these spunbonded processes include:

a) extruding the strands from a spinneret;

b) quenching the strands with a flow of air which is generally cooled in order to hasten the solidification of the molten strands;

c) attenuating the filaments by advancing them through the quench zone with a draw tension that can be applied by either pneumatically entraining the filaments in an air stream or by wrapping them around mechanical draw rolls of the type commonly used in the textile fibers industry;

d) collecting the dawn strands into a web on a foraminous surface; and e) bonding the web of loose strands into a fabric.

This bonding can any thermal or chemical bonding treatment may be used to form a plurality of intermittent bonds, such that a coherent web structure results. Thermal point bonding is most preferred. Various thermal point bonding techniques are known, with the most preferred utilizing calendar rolls with a point bonding pattern. Any pattern known in the art may be used with typical embodiments employing continuous or discontinuous patterns. Preferably, the bonds cover between 6 and 30 percent, and most preferably, 12 percent of the layer is covered. By bonding the web in accordance with these percentage ranges, the filaments are allowed to elongate throughout the full extent of stretching while the strength and integrity of the fabric can be maintained.

All of the spunbonded processes of this type can be used to make the elastic fabric of this invention if they are outfitted with a spinneret and extrusion system capable of producing bi-component filaments. However, one preferred method involved providing a drawing tension from a vacuum located under the forming surface. This method provides for a continually increasing strand velocity to the forming surface, and so provides little opportunity for elastic strands to snap back.

Another class of process, known as meltblowing, can also be used to produce the nonwoven fabrics of this invention. This approach to web formation is described in NRL Report 4364 "Manufacture of Superfine Organic Fibers" by V. A. Wendt, E. L. Boone, and C. D. Fluharty and in U.S. Pat. No. 3,849,241 to Buntin et al. The meltblowing process generally involves:

a.) Extruding the strands from a spinneret.

b.) Simultaneously quenching and attenuating the polymer stream immediately below the spinneret using streams of high velocity air. Generally, the strands are drawn to very small diameters by this means. However, by reducing the air volume and velocity, it is possible to produce strand with deniers similar to common textile fibers.

c.) Collecting the drawn strands into a web on a foraminous surface. Meltblown webs can be bonded by a variety of means, but often the entanglement of the filaments in the web provides sufficient tensile strength so that it can be wound into a roll.

Any meltblowing process which provides for the extrusion of bi-component filaments such as that set forth in U.S. Pat. No. 5,290,626 can be used to practice this invention.

Figure 2:
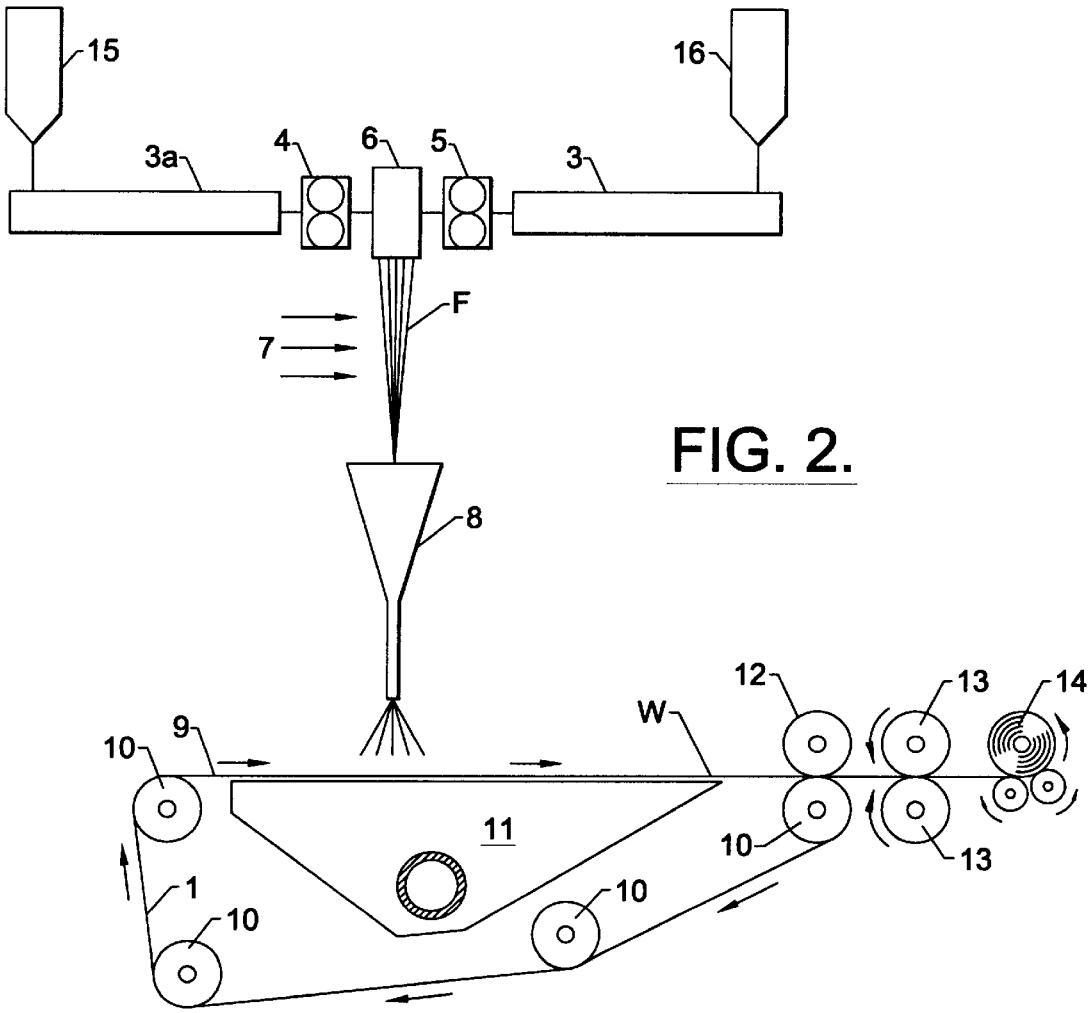
FIG. 2 illustrates one example of a processing line for producing nonwoven fabrics according to the present invention.

For sake of completeness, one example of a suitable processing line for producing nonwovens from multi-component strands is illustrated by FIG. 2. In this figure, a process line 1 is arranged to produce bi-component continuous filaments, but is should be understood that the present invention comprehends nonwoven fabrics made with multi-component filaments having more than two components. For example, the fabric of the present invention can be made with filaments having three or four components. Alternatively, nonwoven fabrics including single component strands, in addition to the multi-component strands can be provided. In such an embodiment, single component and multi-component strands may be combined to form a single, integral web.

The process line 1 includes a pair of extruders 2 and 3 for separate extruding the first and second components. The first and second polymeric materials A, B, respectively, are fed from the extruders 2 and 3 through respective melt pumps 4 and 5 to spinneret 6. Spinnerets for extruding bi-component filaments are well known to those of ordinary skill in the art and thus are not described here in detail. A spinneret design especially suitable for practicing this invention is described in U.S. Pat. No. 5,162,074. The spinneret 6 includes a housing generally described, the spinneret 6 includes a housing containing a spin pack which includes a plurality of plates stacked on top of the other with a pattern of openings arranged to create flow paths for directing polymeric materials A and B separately through the spinneret. The spinneret 6 has openings arranged in one or more rows. The spinneret openings form a downwardly extending curtain of filaments when the polymers are extruded through the spinneret. For example, spinneret 6 may be arranged to form side-by-side or eccentric sheath/core bi-component filaments. Moreover, the spinneret 6 may be arranged to form concentric sheath/core bi-component filaments.

The process line 2 also includes a quench blower 7 positioned adjacent the curtain of filaments extending from the spinneret 6. Air from the quench air blower 7 quenches the filaments extending from the spinneret 6. The quench air can be directed from one side of the filament curtain as shown in FIG. 2, or both sides of the filament curtain.

A fiber draw unit or aspirator 8 is positioned below the spinneret 6 and receives the quenched filaments. Fiber draw units or aspirators for use in melt spinning polymers are well known as discussed above. Suitable fiber draw units for use in the process of the present invention include a linear fiber aspirator and educative guns.

Generally described, the fiber draw unit 8 includes an elongate vertical passage through which the filaments are drawn by aspirating air entering from the sides of the passage and flowing downwardly through the passage. The aspirating air draws the filaments and ambient air through the fiber draw unit.

An endless foraminous forming surface 9 is positioned below the fiber draw unit 8 and receives the continuous filaments from the outlet opening of the fiber draw unit. The forming surface 9 travels around guide rollers 10. A vacuum 11 positioned below the forming surface 9 where the filaments are deposited draws the filaments against the forming surface.

The process line 1 further includes a compression roller 12 which, along with the forward most of the guide rollers 10, receive the web as the web is drawn off of the forming surface 9. In addition, the process line includes a pair of thermal point bonding calendar rolls 13 for bonding the bi-component filaments together and integrating the web to form a finished fabric. Lastly, the process line 1 includes a winding roll 14 for taking up the finished fabric.

To operate the process line 1, the hoppers 15 and 16 are filled with the respective first and second polymer components which are melted and extruded by the respected extruders 2 and 3 through melt pumps 4 and 5 and the spinneret 6. Although the temperatures of the molten polymers vary depending on the polymers used, when, for example, Elastollan 1180 and Exact 3017 LLDDE are used as the first and second components, the preferred temperatures of the polymers at the spinneret range from 205° to about 215° C.

As the extruded filaments extend below the spinneret 6, a stream of air from the quench blower 7 at least partially quenches the filaments. After quenching, the filaments are drawn into the vertical passage of the fiber draw unit 8 by a flow of air through the fiber draw unit. It should be understood that the temperatures of the aspirating air in unit 8 will depend on factors such as the type of polymers in the filaments and the denier of the filaments and would be known by those skilled in the art.

The drawn filaments are deposited through the outer opening of the fiber drawn unit 8 onto the traveling forming surface 9. The vacuum 11 draws the filaments against the forming surface 9 to form an unbonded, nonwoven web of continuous filaments. The web is then lightly compressed by the compression roller 12 and thermal point bonded by bonding rollers 13. Thermal point bonding techniques are well known to those skilled in the art and are not discussed here in detail.

However, it is noted that the type of bond pattern may vary based on the degree of fabric strength desired. The bonding temperature also may vary depending on factors such as the polymers in the filaments.

Although the method of bonding shown in FIG. 2 is thermal point bonding, it should be understood that the fabric of the present invention may be bonded by other means such as oven bonding, ultrasonic bonding, hydroentangling or combinations thereof to make cloth-like fabric. Such bonding techniques such as through air bonding, are well known to those of ordinary skill in the art and are not discussed here in detail.

Lastly, the finished web is wound onto the winding roller 14 and is ready for further treatment or use.

The invention is capable of solving the stickiness and blocking problem associated with previous processes while at the same time providing improved properties. The web can be employed in products such as garments, bandages, and personal hygiene products among others. To this end, the fabric may be treated with conventional surface treatments by methods recognized in the art. For example, conventional polymer additives can be used to enhance the wettability of the fabric. Such surface treatment enhances the wettability of the fabric and thus, facilitates its use as a liner or surge management material for feminine care, infant care, child care, and adult incontinence products.

The fabric of the invention may also be treated with other treatments such as antistatic agents, alcohol repellents and the like, by techniques that would be recognized by those skilled in the art.

The invention will now be described in terms of certain preferred examples thereof. It is to be recognized, however, that these examples are merely illustrative in nature and should in no way limit the scope of the present invention.

EXAMPLES

Example 1

A series of bi-component filaments having a sheath and core arrangement such as that of FIG. 1*a* were produced on a laboratory scale apparatus. The filaments had the following components:

Core—Dow 58200.02 LLDPE

Sheath—85% Dow 6811 A LLDPE and 15% Appryl 3250YR1 polypropylene

The filaments were placed in an Instron tensile tester at 2" gauge length and elongated 50% at a crosshead speed of 5" per minute. The samples were then retracted to zero tensile force and the percent recovery determined. The samples were then elongated a second time to 50% and the percent recovery determined.

TABLE 1

| Ratio of Core/Sheath | Recovery - First Pull | Recovery - Second Pull |
|---|---|---|
| 100% Core | 78 | 77 |
| 95/5 | 74 | 73 |
| 90/10 | 72 | 70 |

The properties of these filaments demonstrate that substantial elasticity can be retained in the sheath/core filament.

Figure 4A:
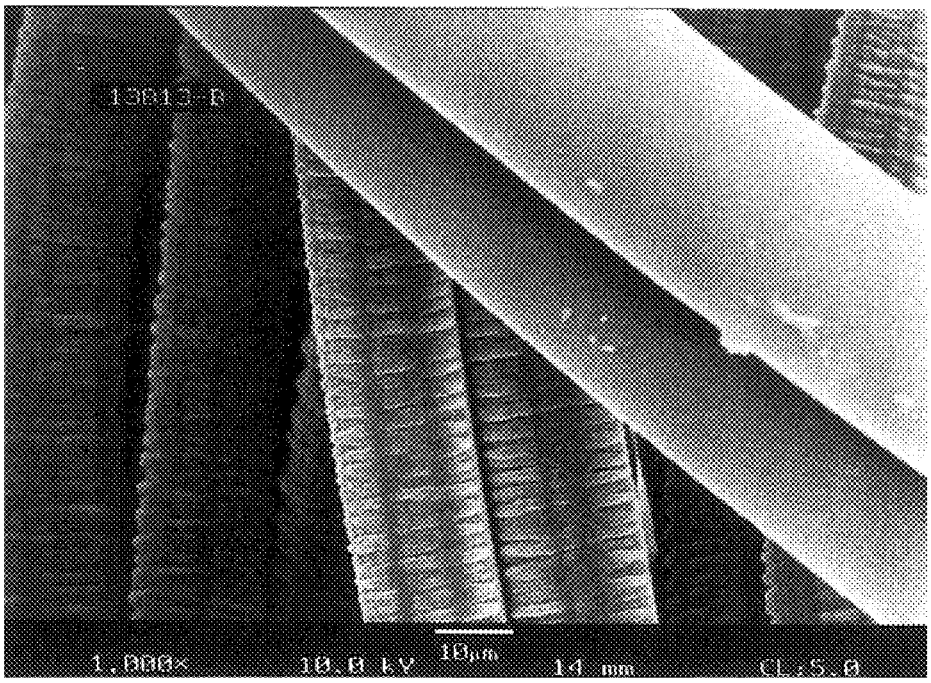
Figure 4B:
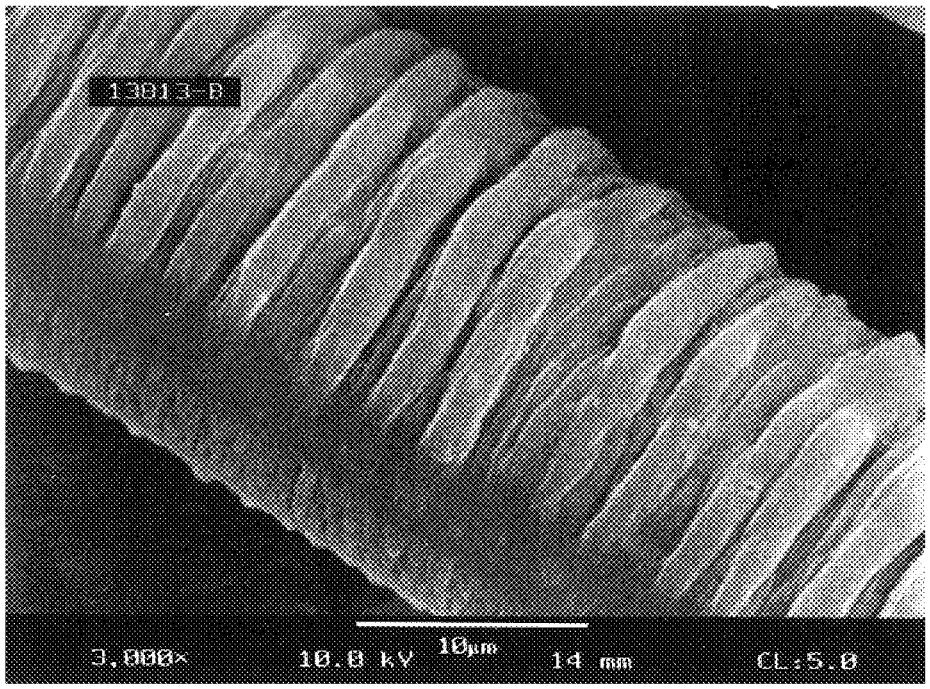

A scanning electron micrograph of a 90/10 core/sheath filament is shown in FIGS. 4*a* and 4*b*. As illustrated in this Figure, the sheath takes on a corrugated appearance during stretching. The corrugated sheath expands during subsequent stretching steps, moving with the expanding elastomer but offering only a small amount of resistance.

Example 2

A series of bi-component filaments having a sheath and core arrangement is made in the same apparatus as used in example 1. The filaments had the following components:

Core—50% Kraton 1657G and 50% Exact 5009 LLDPE

Sheath—85% Dow 6811A LLDPE and 15% Appryl 3250YR1 polypropylene

The filaments were placed in an Instron tensile tester at 2" gauge length and elongated 50% at a crosshead speed of 5" per minute. The samples were then retracted to zero tensile force and the percent recovery determined. The samples were then elongated a second time to 50% elongation and the percent recovery determined.

TABLE 2

| Ratio of Core/Sheath | Recovery - First Pull | Recovery - Second Pull |
|---|---|---|
| 100% Core | 86 | 80 |
| 95/5 | 89 | 78 |
| 90/10 | 78 | 76 |

Figure 5A:
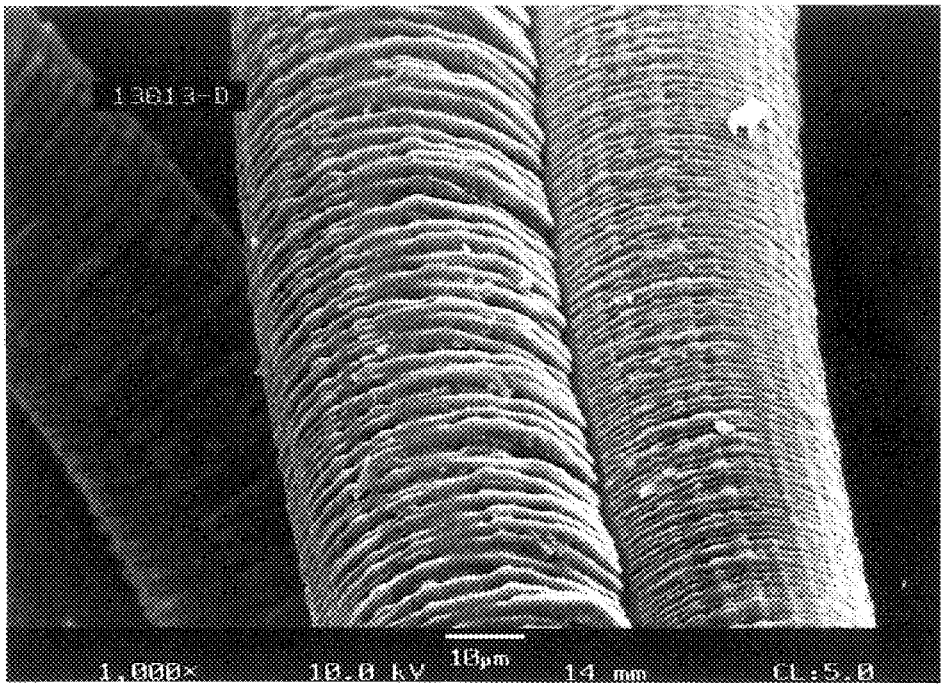
Figure 5B:
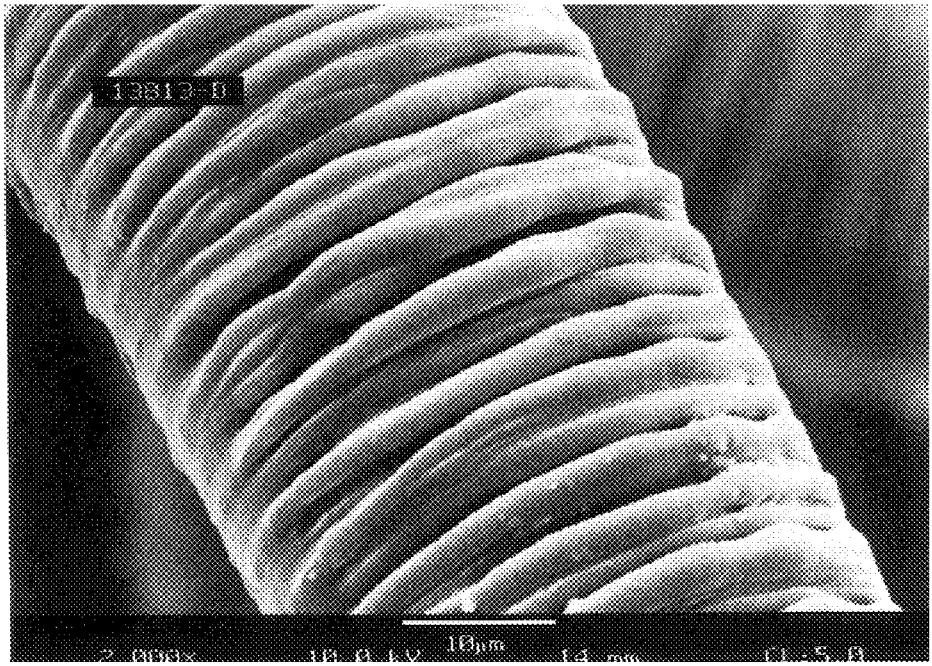

The properties of these filaments demonstrate that substantial elasticity can be retained in the sheath/core filament. A scanning electron micrograph of the 90/10 core/sheath filament is shown in FIGS. 5*a* and 5*b*.

Example 3

A series of bi-component filaments having a sheath and core arrangement is made using the apparatus in Example 1. The filaments had the following components:

Core—Elastic polypropylene copolymer (Amoco 19725-107 with 8% ethylene content)

Sheath—Dow 6811 A LLDPE

The filaments were placed in an Instron tensile tester at 2" gauge length and elongated 50% at a crosshead speed of 5" per minute. The samples were then retracted to zero tensile force and the percent recovery determined. The samples were then elongated a second time to 50% elongation and the percent recovery determined.

TABLE 3

| Ratio of Core/Sheath | Recovery - First pull | Recovery - Second Pull |
|---|---|---|
| 100% Core | 78 | 76 |
| 95/5 | 71 | 67 |
| 90/10 | 64 | 64 |
| 85/15 | 69 | 64 |

The properties of these filaments demonstrate that substantial elasticity can be retained in the sheath/core filament.

Example 4–10

The examples described in Table 4 were prepared on an apparatus similar to that described in FIG. 2. A bi-component spinneret similar to that described in U.S. Pat. No. 5,162,074 was used to prepare the bonded webs containing bi-component filaments. The design of this apparatus was such that it was not possible to go above 85% core content in the sheath core filament. Consequently, fabrics produced from these bonded webs were not expected to have properties as elastic as fabrics made from bi-component filaments with cores of 90% or greater elastomer content.

Attenuation air was provided for the drawing slot by a vacuum located below the forming wire. The webs were bonded in a calendar outfitted with a smooth steel roll and a roll having raised bosses covering 16% of the area of the roll. The elastic properties of the bonded webs were measured using an Instron testing apparatus set at a 2 inch gauge length and a stretching rate of 5 inches per minute. The samples were elongated at 50% elongation, held in a stretched state for 30 seconds, and then allowed to relax to zero force. The percent recovery from the amount of the original elongation was measured. The elongation recovery values were measured after both a first pull and a second pull. Elongation recovery values were measured in both the machine direction and the cross direction, to give a root mean square values which is listed in Table 5. In every case, elastic recovery is increased by inserting an elastic core into the filaments of the web.

Example 6 illustrates a web prepared from highly elastic (and "sticky") Elastollan 1180 polyurethane. This web had a tendency to "block" when it was wound up. When a web was prepared in Example 10 from sheath/core filaments with Elastollan 1180 cores, the bonded web became manageable and could be wound up and subsequently unwound. The recovery properties of this bonded web were intermediate between those observed for bonded webs of 100% Exact 3017 (Example 5) and 100% Elastollan 11180 (Example 6).

Example 7 illustrates a web prepared from the highly elastic (and very "sticky") blend of 50% Kraton 1657G and 50% Exact 5009 LLDPE. This web was thermal point bonded but was not wound into a roll because of its tendency to block. When a web was prepared in Example 9 from sheath/core filaments with a Kraton 1657G blend in the core, the bonded web became manageable and could be wound up and subsequently unwound. The recovery properties of this bonded web were intermediate between those observed for bonded webs of 100% Exact 3017 (Example 5) and a 100% Kraton/Exact LLDPE blend (Example 7).

TABLE 4

| Example | Filament Components | Filament Composition | Basis Weight gsm |
|---|---|---|---|
| 4 | Single | Blend of 85% Dow 6811A LLDPE and 15% Appryl | 28 |
| 5 | Single | Exact 3017 LLDPE | 46 |
| 6 | Single | Elastollan 1180 Polyurethane elastomer | 283 |
| 7 | Single | Blend of 50% Kraton 1657G and 50% Exact 5009 LLDPE | 332 |
| 8 | Bi-component 50% Sheath 50% Core | Sheath - Blend of 85% Dow 6811A LLDPE and 15% Appryl 3250YR; Polypropylene<br>Core - Blend of 67% Kraton 1657G and 33% Exact 3017 LLDPE | 46 |
| 9 | Bi-component 20% Sheath 80% Core | Sheath - Exact 3017 LLDPE<br>Core - Blend of 67% Kraton 1657G and 33% Exact 3017 LLDPE | 141 |
| 10 | Bi-component 15% Sheath 85% Core | Sheath - Exact 3017 LLDPE<br>Core - Elastollan 1180 Polyurethane elastomer | 265 |

TABLE 5

ROOT MEAN SQUARE RECOVERIES 50% ELONGATION

| Example | MD Recovery Pull 1 - % | MD Recovery Pull 2 - % | CD Recovery Pull 1 - % | CD Recovery Pull 2 - % | RMS Recovery Pull 1 - % | RMS Recovery Pull 2 - % |
|---|---|---|---|---|---|---|
| 4 | 59.9 | 53.9 | 56.8 | 50.4 | 58.4 | 52.2 |
| 5 | 74.2 | 69.2 | 63.2 | 59.0 | 68.9 | 64.4 |
| 6 | 95.3 | 94.9 | 90.1 | 88.0 | 92.7 | 91.0 |
| 7 | 88.8 | 87.3 | 85.1 | 82.0 | 87.0 | 84.7 |
| 8 | 71.0 | 65.5 | 70.9 | 65.5 | 71.0 | 65.5 |
| 9 | 90.2 | 88.5 | 63.9 | 59.3 | 78.2 | 75.2 |
| 10 | 89.4 | 87.3 | 83.2 | 81.0 | 86.4 | 84.2 |

Two Dimensional Stretching

The elastic performance of these fabrics can also be evaluated in two dimensional stretching. This was done using a TM Long Biaxial Stretcher at room temperature. A 2 ½"×2½" swatch of fabric was held in place in the stretcher by clamps. The fabric was uniformly elongated in both directions until a breakage was observed, usually at the edges of the stretched fabric. The elongated area was recorded at the time of the breakage. The results of this experiment are given in Table 6.

The three examples made from bi-component filaments had area extensions greater than the examples made from nonelastic (Example 4) and slightly elastic (Example 5) sheath materials.

TABLE 6

BIAXIAL STRETCHING

| Example | Area Extension |
|---|---|
| 4 | 650% |
| 5 | 675% |
| 6 | 1600% |
| 7 | 1600% |
| 8 | 800% |
| 9 | 1600% |
| 10 | 1025% |

While this invention has been described in terms of certain preferred embodiments thereof, it should be recognized that various modifications, substitutions, omissions, changes and the like may be made to the invention without departing from the spirit thereof accordingly, the scope of the invention should be limited only by the scope of the following claims including equivalents thereof

What is claimed is:

1. A bonded nonwoven web comprising a plurality of multi-component strands, each strand comprising a first polymeric component and a second polymeric component arranged in a core and sheath arrangement with the core comprising the first component and the sheath comprising the second component, wherein the first component comprises at least one elastomer and has an elasticity that is greater than the second component, and wherein the second component comprises at least 50 percent by weight of a linear low density polyethylene having a density greater than 0.90 g/cc.

2. The web according to claim 1 wherein the web has a root mean square average recoverable elongation of about 65% or more based on machine direction and cross-direction recoverable elongation values after 50% elongation of the web and one pull.

3. The web according to claim 1 wherein the second component is present in an amount less than about 50% by weight of the strand.

4. The web according to claim 1 wherein the second component is present in an amount of about 1 to about 20% by weight of the strand.

5. The web according to claim 1 wherein the second component is present in an amount of about 5 to 10% by weight of the strand.

6. The web according to claim 1 wherein the at least one elastomer includes a block copolymer.

7. The web according to claim 1 wherein the at least one elastomer includes a linear low density polyethylene of density less than 0.90 g/cc.

8. The web according to claim 1 wherein the at least one elastomer includes an elastic polypropylene.

9. The web according to claim 1 where the second component comprises two or more polyolefins.

10. The web according to claim 9 where the second component is a blend of polyethylene and polypropylene.

11. The web according to claim 1 wherein the second component is present in an amount such that the strand becomes elastic only upon stretching of the strand by an amount sufficient to irreversibly alter the original length of the second component zone.

12. A personal hygiene product comprising a bonded web according to claim 1.

13. A garment product comprising a bonded web according to claim 1.

14. A bandaging material comprising a bonding web according to claim 1.

15. A bonded nonwoven web comprising a plurality of bicomponent strands, and a plurality of bonds bonding the strands together, each strand comprising a first polymeric component and a second polymeric component arranged in a core and sheath arrangement with the core comprising the first component and the sheath comprising the second component, wherein the first component comprises at least one elastomer and has an elasticity that is greater than the second component, and wherein the second component comprises at least 50 percent by weight of a linear low density polyethylene having a density greater than 0.90 g/cc.

16. The web according to claim 15 wherein said second component also includes from 5 to 50 percent by weight polypropylene.

17. The web according to claim 15 wherein said core includes a linear low density polyethylene having a density greater than 0.90 g/cc.

18. A spunbonded web comprising a plurality of multi-component filaments, and a plurality of spaced apart point bonds bonding the filaments to one another, each said multi-component filament comprising a first polymeric component and a second polymeric component arranged in a core and sheath arrangement with the core comprising the first component and the sheath comprising the second component, wherein the first component comprises at least one elastomer and has an elasticity that is greater than the second component, and wherein the second component comprises a blend of polypropylene and at least 50 percent by weight of a linear low density polyethylene having a density greater than 0.90 g/cc.

* * * * *